US008945317B2

(12) United States Patent
Avoyan et al.

(10) Patent No.: US 8,945,317 B2
(45) Date of Patent: Feb. 3, 2015

(54) SYSTEM AND METHOD FOR CLEANING GAS INJECTORS

(71) Applicant: Lam Research Corporation, Fremont, CA (US)

(72) Inventors: Armen Avoyan, Oakland, CA (US); Cliff La Croix, Fremont, CA (US); Hong Shih, Fremont, CA (US); Allan Ronne, Fremont, CA (US); John Daugherty, Fremont, CA (US); Catherine Zhou, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 124 days.

(21) Appl. No.: 13/650,429

(22) Filed: Oct. 12, 2012

(65) Prior Publication Data

US 2013/0146095 A1 Jun. 13, 2013

Related U.S. Application Data

(60) Provisional application No. 61/567,693, filed on Dec. 7, 2011.

(51) Int. Cl.
*B08B 9/02* (2006.01)

(52) U.S. Cl.
USPC ..... 134/166 R; 134/22.1; 134/34; 134/22.12

(58) Field of Classification Search
CPC ..... H01L 21/67051; H01L 21/67028; H01L 21/50; H01L 23/10; H01J 37/32862; H01J 37/3244; B08B 9/032; C23C 16/45574; C23C 16/45521
USPC ..... 134/166 R, 166 C, 167 R, 167 C, 168 R, 134/168 C, 169 R, 169 C, 170, 171, 172, 134/173, 174, 175, 177, 178, 182, 183, 184, 134/186, 187, 190, 192, 193, 22.1, 22.11
See application file for complete search history.

(56) References Cited

U.S. PATENT DOCUMENTS

| | | | | |
|---|---|---|---|---|
| 2004/0173153 | A1* | 9/2004 | Muramatsu et al. | 118/715 |
| 2008/0223401 | A1 | 9/2008 | Augustino et al. | |
| 2011/0052833 | A1 | 3/2011 | Hanawa et al. | |

FOREIGN PATENT DOCUMENTS

| | | |
|---|---|---|
| JP | 2004-267870 | 9/2004 |
| KR | 10-0712728 B1 | 5/2007 |
| KR | 10-2011-0090120 | 8/2011 |

OTHER PUBLICATIONS

Korean Intellectual Property Office Search Report and Written Opinion mailed Mar. 19, 2013 in reference to co-pending International Application No. PCT/US2012/066744 filed Nov. 28, 2011.

*Primary Examiner* — Michael Barr
*Assistant Examiner* — Irina Graf
(74) *Attorney, Agent, or Firm* — Beyer Law Group LLP

(57) ABSTRACT

An injector cleaning apparatus with a concentric dual flow introducer and a flow-dispersing injector seat along with a method of cleaning an injector. The concentric dual flow introducer has concentric cleaning fluid flowpaths configured to communicate with a central passage and a plurality of peripheral passages of a gas injector. The input-side injector engaging interface of the concentric dual flow introducer and the flow-dispersing injector seat each have a compressible sealing portion having compressibility sufficient to yield under fluid cleaning surges attributable to initiation and termination of cleaning fluid flow through the injector cleaning apparatus along with resiliency sufficient to prevent abutment of the gas injector and a rigid facing portion of the input-side injector engaging interface and output-side injector engaging interface respectively.

12 Claims, 11 Drawing Sheets

SYSTEM AND METHOD FOR CLEANING GAS INJECTORS

CROSS-REFERENCE TO RELATED APPLICATIONS

This application claims the benefit of U.S. Provisional Application Ser. No. 61/567,693, filed Dec. 7, 2011.

BACKGROUND

1. Field

The present disclosure relates to a system and method of cleaning the interior surfaces of a gas injector.

2. Technical Background

Gas injectors are used as part of plasma processing systems for plasma processing of substrates such as semiconductor wafers. These applications require the gas injectors to be free of contaminants because contaminants would potentially yield unacceptable work product. Conventionally, injectors are cleaned by manually scrubbing the interior surfaces to the extent accessible augmented with ultrasonic cleaning. Such a procedure is believed to not render the injector free of particulate contaminants such as ceramic and Yttria particles. The present inventors have recognized a need for alternatives to the aforementioned cleaning process and, more particularly, more effective alternatives for removing particles, such as ceramic and Yttria particles, from the confined surfaces of an injector.

BRIEF SUMMARY

According to the subject matter of the present disclosure, an injector cleaning apparatus is provided to clean the interior surfaces of a gas injector. The injector cleaning apparatus and associated procedure is intended to remove particles, for example ceramic and Yttria particles, from the confined surfaces of an injector. The injector cleaning apparatus may serve to clean or flush out particles following conventional scrub and ultrasonic cleaning.

In accordance with one embodiment of the present disclosure, an injector cleaning apparatus comprises a concentric dual flow introducer and a flow-dispersing injector seat. The concentric dual flow introducer comprises an inner concentric cleaning fluid flowpath configured to communicate with a central passage of a gas injector, an outer concentric cleaning fluid flowpath configured to communicate with a plurality of peripheral passages of a gas injector, and an input-side injector engaging interface. The input side injector engaging interface comprises a compressible sealing portion and a rigid facing portion. The compressible sealing portion of the input-side injector engaging interface has compressibility sufficient to yield under fluid cleaning surges attributable to initiation and termination of cleaning fluid flow through the injector cleaning apparatus and resiliency sufficient to prevent abutment of a gas injector and the rigid facing portion of the input-side injector engaging interface and maintain an input-side injector floating gap between an injector and the rigid facing portion of the input-side injector engaging interface. The flow-dispersing injector seat comprises an output-side injector engaging interface having a compressible sealing portion and a rigid facing portion. The compressible sealing portion of the output-side injector engaging interface has compressibility sufficient to yield under fluid cleaning surges attributable to initiation and termination of cleaning fluid flow through the injector cleaning apparatus and resiliency sufficient to prevent abutment of a gas injector and the rigid facing portion of the output-side injector engaging interface and maintain an output-side injector floating gap between an injector and the rigid facing portion of the output-side injector engaging interface.

In accordance with another embodiment of the present disclosure, an injector cleaning apparatus comprises a concentric dual flow introducer, a flow-dispersing injector seat, an inner flow control module, and an outer flow control module. The concentric dual flow introducer comprises an inner concentric cleaning fluid flowpath configured to communicate with a central passage of a gas injector, an outer concentric cleaning fluid flowpath configured to communicate with a plurality of peripheral passages of a gas injector, and an input-side injector engaging interface. The input-side injector engaging interface has a compressible sealing portion and a rigid facing portion. The compressible sealing portion of the input-side injector engaging interface has compressibility sufficient to yield under fluid cleaning surges attributable to initiation and termination of cleaning fluid flow through the injector cleaning apparatus and resiliency sufficient to prevent abutment of a gas injector and the rigid facing portion of the input-side injector engaging interface and maintain an input-side injector floating gap between an injector and the rigid facing portion of the input-side injector engaging interface. The flow-dispersing injector seat includes an inner base ring, an outer base ring, and an output-side injector engaging interface comprising a compressible sealing portion and a rigid facing portion. The compressible sealing portion of the output-side injector engaging interface has compressibility sufficient to yield under fluid cleaning surges attributable to initiation and termination of cleaning fluid flow through the injector cleaning apparatus and resiliency sufficient to prevent abutment of a gas injector and the rigid facing portion of the output-side injector engaging interface and maintain an output-side injector floating gap between an injector and the rigid facing portion of the output-side injector engaging interface. The inner flow control module is configured to regulate flow of deionized water and compressed dry air to the inner concentric cleaning fluid flowpath and the outer flow control module is configured to regulate flow of deionized water and compressed dry air to the outer concentric cleaning fluid flowpath.

In accordance with another embodiment of the present disclosure, a method of cleaning a gas injector is disclosed. The method comprises providing an injector cleaning apparatus comprising a concentric dual flow introducer, a flow-dispersing injector seat, an inner control module, and an outer control module. The concentric dual flow introducer comprises an inner concentric cleaning fluid flowpath configured to communicate with a central passage of a gas injector and an outer concentric cleaning fluid flowpath configured to communicate with a plurality of peripheral passages of a gas injector. The method further comprises introducing deionized water and compressed dry air into the inner concentric cleaning fluid flowpath and introducing deionized water and compressed dry air into the outer concentric cleaning fluid flowpath. The concentric dual flow introducer also includes an input-side injector engaging interface comprising a compressible sealing portion and a rigid facing portion. The compressible sealing portion of the input-side injector engaging interface has compressibility sufficient to yield under fluid cleaning surges attributable to initiation and termination of cleaning fluid flow through the injector cleaning apparatus and resiliency sufficient to prevent abutment of a gas injector and the rigid facing portion of the input-side injector engaging interface and maintain an input-side injector floating gap between an injector and the rigid facing portion of the input-side injector engaging interface. The flow-dispersing injector seat comprises an output-side injector engaging interface comprising a compressible sealing portion and a rigid facing portion. The compressible sealing portion of the output-side injector engaging interface has compressibility sufficient to yield under fluid cleaning surges attributable to initiation and termination of cleaning fluid flow through the injector cleaning apparatus and resiliency sufficient to prevent abutment of a gas injector and the rigid facing portion of the output-side injector engaging interface and maintain an output-side injector floating gap between an injector and the flow-dispersing injector seat. The inner flow control module regulates flow of deionized water and compressed dry air to the inner concentric cleaning fluid flowpath and the outer flow control module regulates flow of deionized water and compressed dry air to the outer concentric cleaning fluid flowpath.

BRIEF DESCRIPTION OF THE SEVERAL VIEWS OF THE DRAWINGS

The following detailed description of specific embodiments of the present disclosure can be best understood when read in conjunction with the following drawings, where like structure is indicated with like reference numerals and in which.

DETAILED DESCRIPTION

Figure 1:
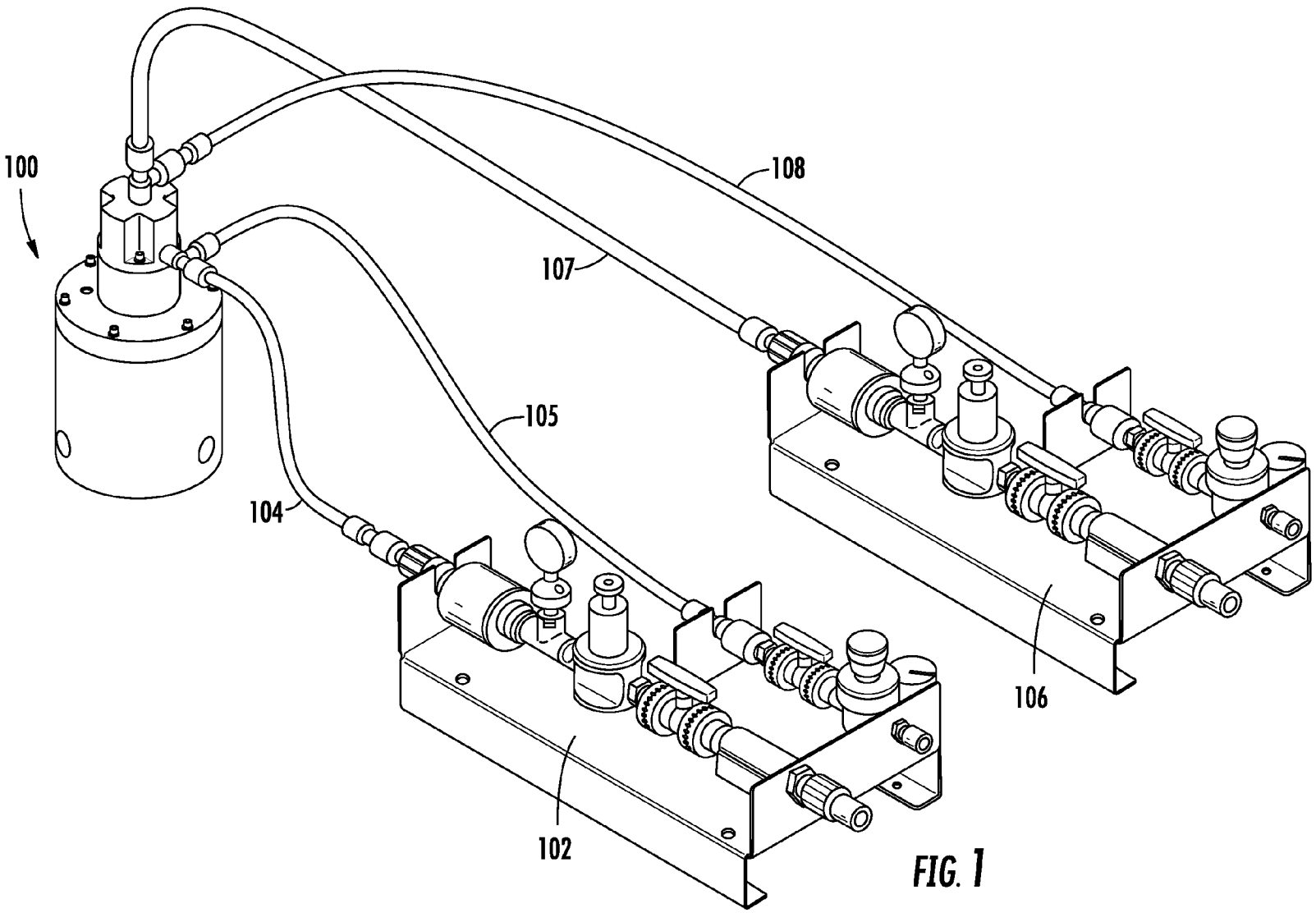
FIG. 1 is a schematic illustration of an injector cleaning apparatus according to one embodiment of the present disclosure.

Referring to the drawings in general and to FIG. 1 in particular, it will be understood that the illustrations are for the purpose of describing a particular embodiment of the invention and are not intended to limit the invention thereto. An injector cleaning apparatus 100 for cleaning injectors comprises an associated outer flow control module 102 and inner flow control module 106. The outer flow control module 102 and inner flow control module 106 comprise valves, pressure regulators, flow regulators, and/or other known hardware and instrumentation. The outer flow control module 102 and inner flow control module 106 control flow of deionized water and compressed dry air (CDA) to different portions of the injector cleaning apparatus 100 and clean different parts of the injector 140. The outer flow control module 102 and inner flow control module 106 have independent pressure control allowing for different pressures or flow rates of deionized water and/or CDA.

Figure 2B:
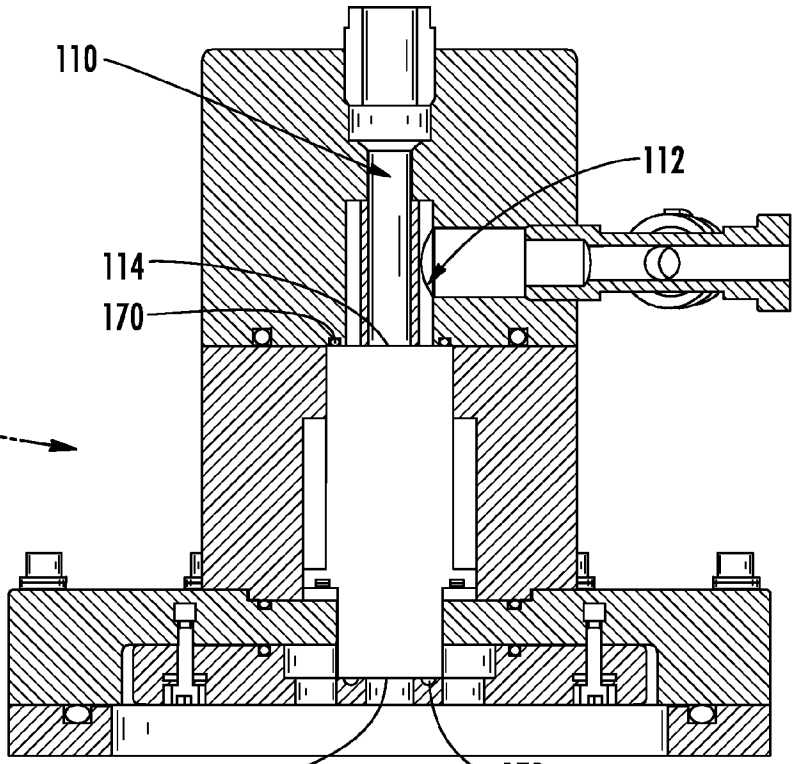
FIG. 2B is a detail cut view of an injector cleaning apparatus according to one embodiment of the present disclosure (injector shown as silhouette for clarity of injector cleaning apparatus)
Figure 2A:
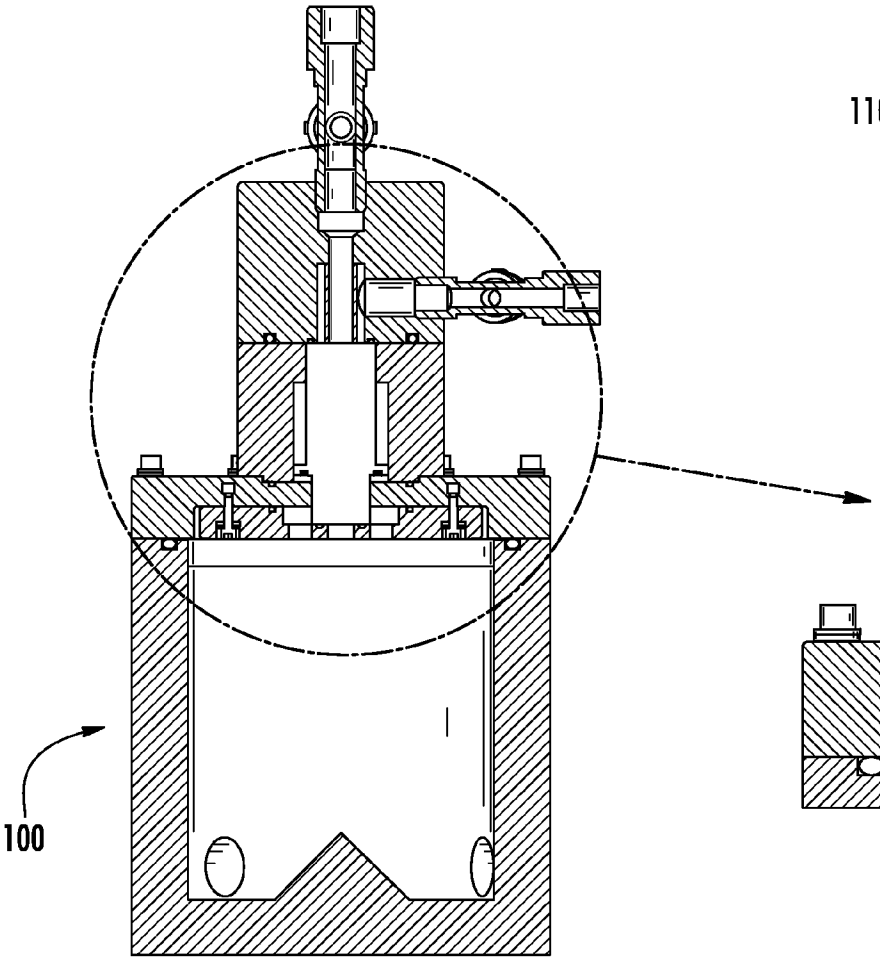
FIG. 2A is a cut side view of an injector cleaning apparatus according to one embodiment of the present disclosure (injector shown as silhouette for clarity of injector cleaning apparatus)

Referring to FIGS. 2A and 2B, the injector 140 is shown as a silhouette for enhanced clarity of the injector cleaning apparatus 100. In an embodiment, the injector cleaning apparatus 100 has an Inner Zone 110 and an Outer Zone 112. The Inner Zone 110 and Outer Zone 112 are distinct and independent fluid pathways which communicate with different parts of the injector 140. The Inner Zone 110 communicates with the central passage 148 of the injector 140. The Outer Zone 112 communicates with the peripheral passages 146 of the injector 140. The design ensures uniform flow across the different peripheral passages 146 of the injector 140.

Referring further to FIGS. 1, 2A and 2B, in an embodiment, the outer flow control module 102 supplies inputs to the Outer Zone 112 of the injector cleaning apparatus 100. An outer fluid supply 104 directs deionized water to the outer zone aperture 124 and an outer air supply 105 directs compressed dry air to the outer zone aperture. The deionized water and CDA, controlled by the outer flow control module 102, clean the peripheral passages 146 of the injector 140. The outer flow control module 102 regulates flow of deionized water into the outer zone aperture 124 and peripheral passages 146 with one selected example flow rate being approximately 3.5 to approximately 4.0 gallons per minute. The outer flow control module 102 regulates flow of compressed dry air into the outer zone aperture 124 and peripheral passages 146 with one selected example compressed dry air pressure being between approximately 40 and approximately 45 psi. An additional selected embodiment includes a deionized water flow of approximately 5.5 to approximately 6.5 gallons per minute and a compressed dry air pressure of between approximately 30 and approximately 40 psi.

In an embodiment, the inner flow control module 106 supplies inputs to the Inner Zone 110 of the injector cleaning apparatus 100. An inner fluid supply 107 directs deionized water to the inner zone aperture 122 and an inner air supply 108 directs compressed dry air to the inner zone aperture. The deionized water and CDA, controlled by the inner flow control module 106, clean the central passage 148 of the injector 140. The inner flow control module 106 regulates flow of deionized water into the inner zone aperture 122 and central passage 148 with one selected example flow rate being approximately 3.5 to approximately 4.0 gallons per minute. The inner flow control module 106 regulates flow of compressed dry air into the inner zone aperture 122 and central passage 148 with one selected example compressed dry air pressure being between approximately 40 and approximately 45 psi. An additional selected embodiment includes a deionized water flow of approximately 5.5 to approximately 6.5 gallons per minute and a compressed dry air pressure of between approximately 30 and approximately 40 psi.

Figure 3B:
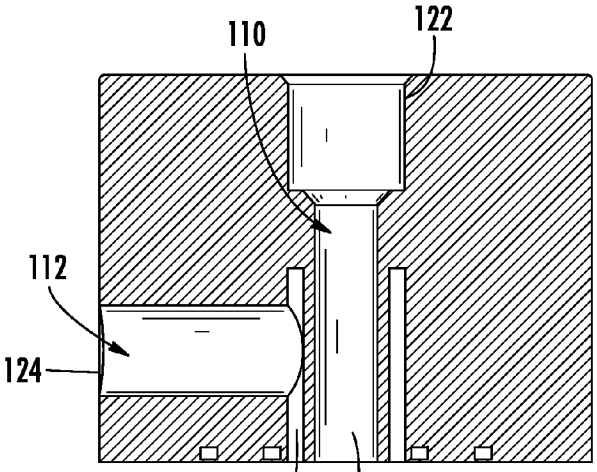
FIG. 3B is a cut view of FIG. 3A.
Figure 3C:
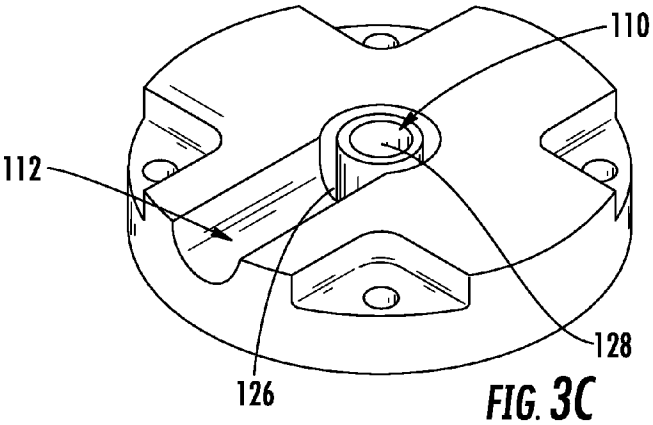
FIG. 3C is an alternate cut view of FIG. 3A.
Figure 3A:
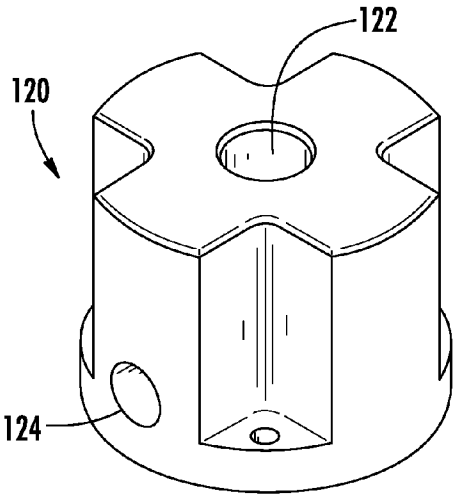
FIG. 3A is an isometric view of a concentric dual flow introducer according to one embodiment of the present disclosure.

Referring to FIG. 3A, the injector cleaning apparatus 100 comprises a concentric dual flow introducer 120. The concentric dual flow introducer 120 comprises apertures to introduce fluids into the Inner Zone 110 and the Outer Zone 112; specific examples of apertures include an Inner Zone aperture 122 and an Outer Zone aperture 124.

Referring to FIG. 3B, a cut view of FIG. 3A, the structure of an embodiment of the Inner Zone 110 and Outer Zone 112 is shown. The Outer Zone 112 comprises an outer passage 126 and the Inner Zone 110 comprises an inner passage 128. Referring to FIG. 3C, an alternate cut view of FIG. 3A, the outer passage 126 and the inner passage 128 are further illustrated.

Figures 4, 5:
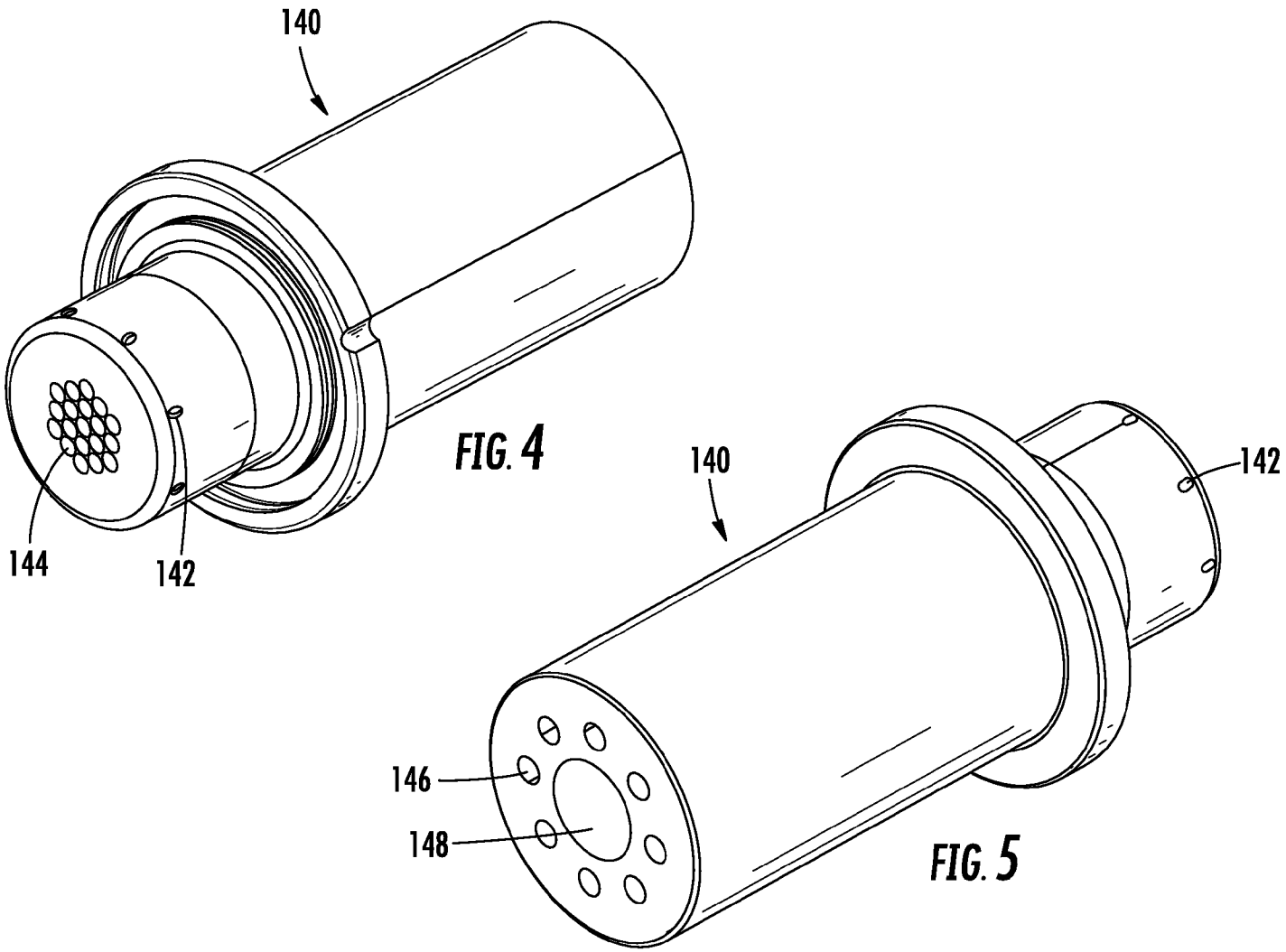
FIG. 4 is an isometric view of an injector.
FIG. 5 is an isometric view of an injector.

Referring to FIG. 4, an injector 140 is shown. The injector 140 comprises a plurality of peripheral outlets 142 and a plurality of central outlets 144.

Referring to FIG. 5, an alternate view of injector 140 is shown. The injector 140 further comprises a plurality of peripheral passages 146 and at least one central passage 148. The peripheral passages 146 terminate at the peripheral outlets 142. The central passage 148 terminates at the central outlets 144. Fluid used in an injector cleaning operation is introduced into the injector 140 via the peripheral passages 146 and central passage 148 and then ejected from the injector via peripheral outlets 142 and central outlets 144.

Figure 6:
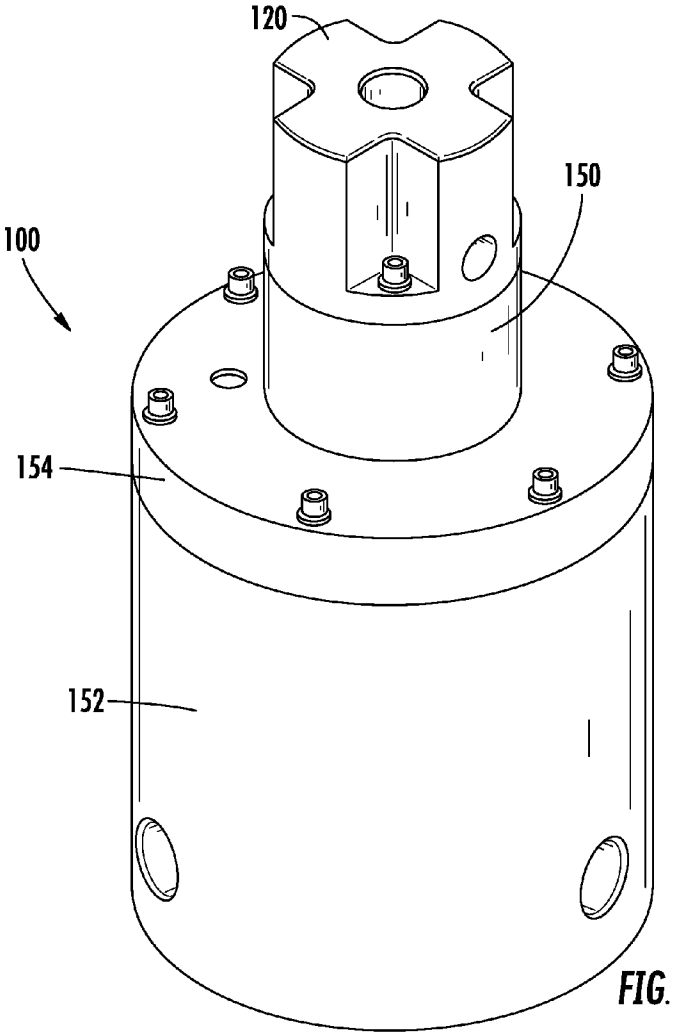
FIG. 6 is an isometric view of an injector cleaning apparatus according to one embodiment of the present disclosure.

Referring to FIG. 6, an embodiment of the assembled injector cleaning apparatus 100 is shown. In addition to the concentric dual flow introducer 120, the injector cleaning apparatus 100 further comprises a spacer ring 150, a discharge chamber 152, and an outer base ring 154.

Figure 7:
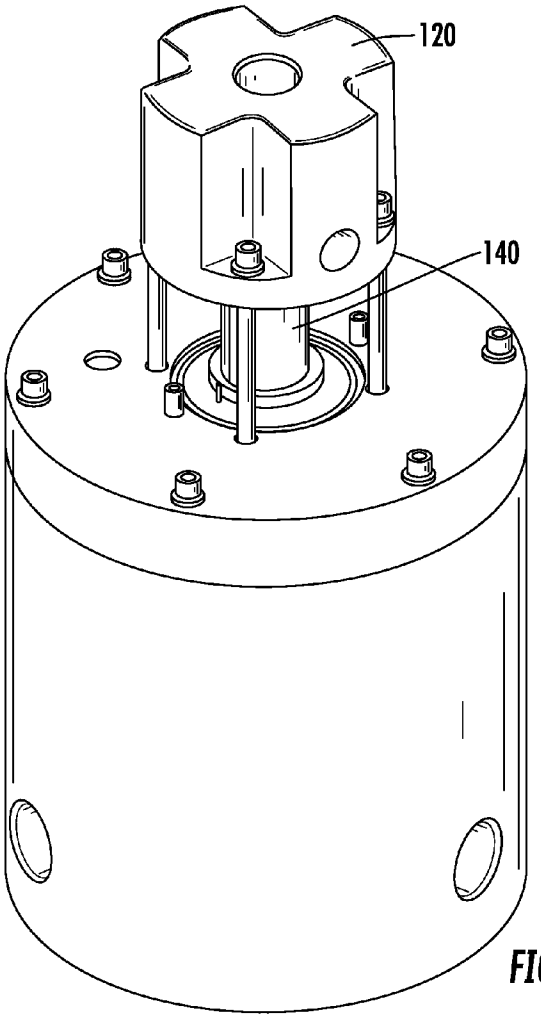
FIG. 7 is an isometric view of an injector cleaning apparatus according to one embodiment of the present disclosure with the spacer ring removed.

Referring to FIG. 7, an embodiment of the injector cleaning apparatus 100 is shown with the spacer ring 150 removed to reveal the injector 140.

Figure 8:
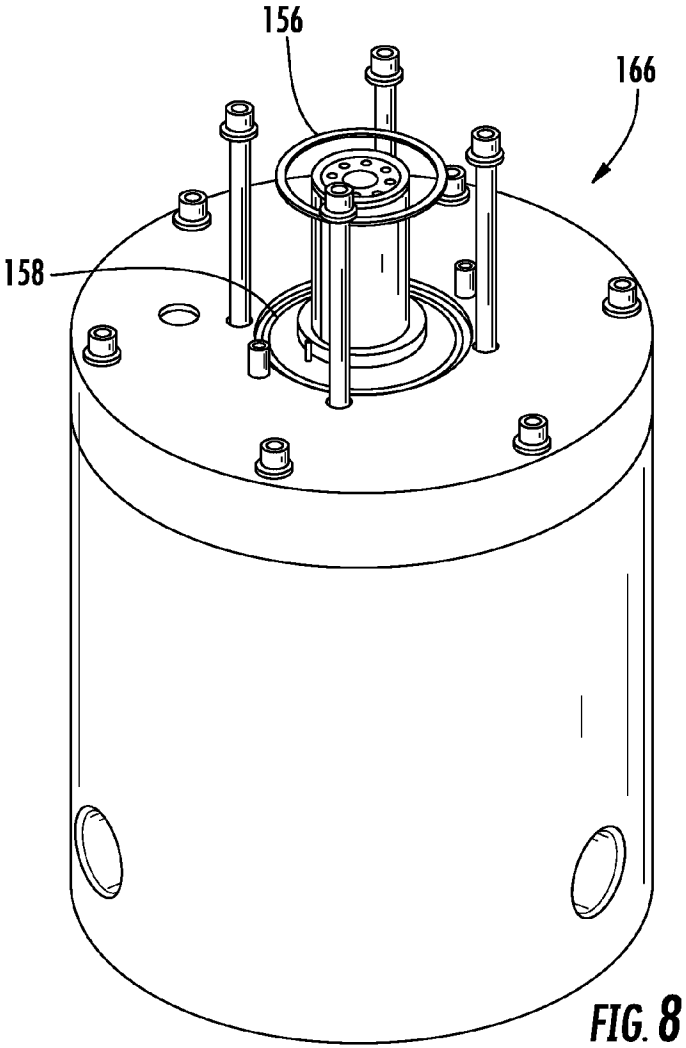
FIG. 8 is an isometric view of an injector cleaning apparatus according to one embodiment of the present disclosure with the concentric dual flow introducer further removed.

Referring to FIG. 8, an embodiment of the injector cleaning apparatus 100 is shown with the concentric dual flow introducer 120 and spacer ring 150 removed to reveal a flow introducer seal 156. A spacer ring seal 158 is also shown which separates the outer base ring 154 and the spacer ring 150. While an O-ring type seal is shown for the flow introducer seal 156 and the spacer ring seal 158, other embodiments include other types and styles of seals known in the art.

Figure 9:
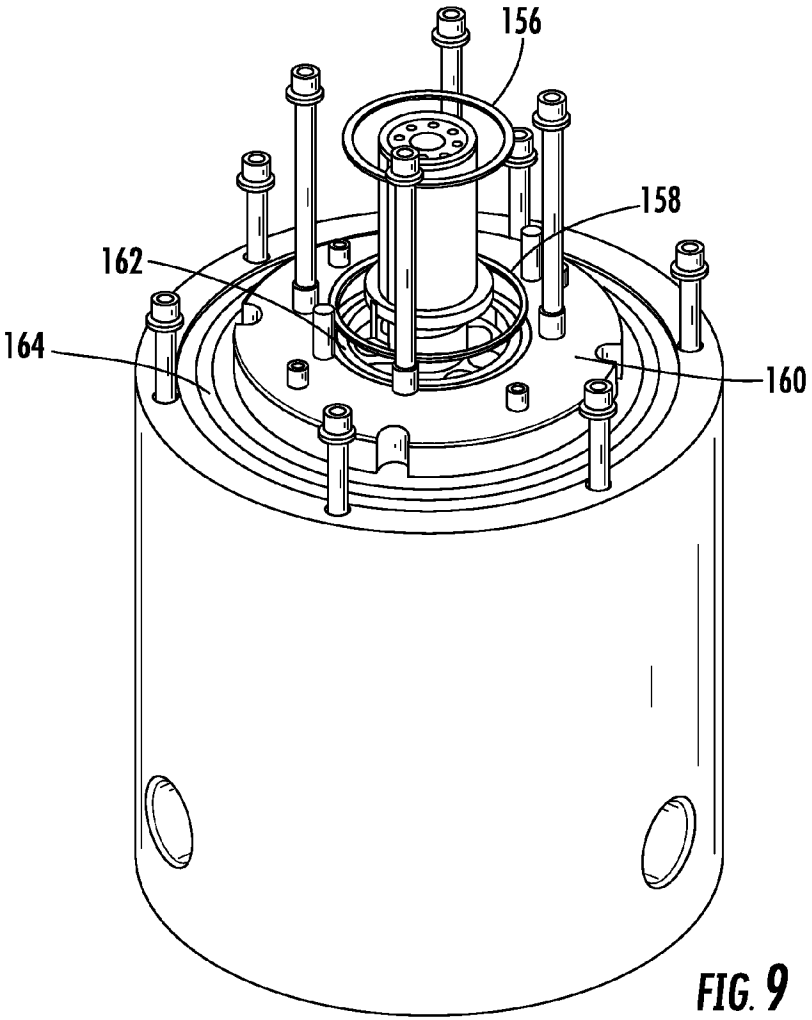
FIG. 9 is an isometric view of an injector cleaning apparatus according to one embodiment of the present disclosure with the outer base ring further removed.

Referring to FIG. 9, the injector cleaning apparatus 100 is shown with the outer base ring 154 removed to reveal an inner base ring 160. The inner base ring 160 and outer base ring 154 are separated by an inner base ring seal 162 and an outer base ring seal 164. While an O-ring type seal is shown for the inner base ring seal 162 and outer base ring seal 164, alternate embodiments include other types and styles of seals known in the art.

In an embodiment (not shown) the outer base ring 154 and the inner base ring 160 are a single component. The outer base ring 154 and the inner base ring 160, either as a single component or multiple components, are collectively called the flow-dispersing injector seat 166.

Figure 10:
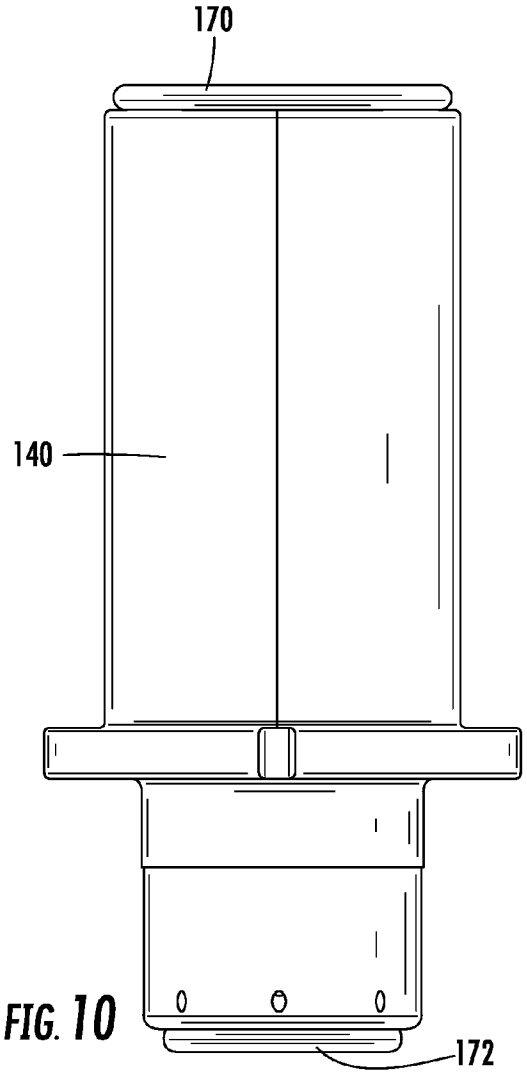
FIG. 10 is a side view of an injector in conjunction with injector seals according to one embodiment of the present disclosure

Referring to FIG. 10, the injector 140 is shown removed from the injector cleaning apparatus 100. When installed in the injector cleaning apparatus 100, the injector 140 is separated from the concentric dual flow introducer 120 by an upper injector seal 170 and separated from the inner base ring 160 by a lower injector seal 172. The upper injector seal 170 and the lower injector seal 172 are compressible and allow the injector 140 to float in the injector cleaning apparatus 100 between the inner base ring 160 and the concentric dual flow introducer 120 while remaining engaged with the upper injector seal and lower injector seal. The floating arrangement of the injector 140 in the injector cleaning apparatus 100 allows for improved shock absorption when the pressure or flow rate of fluid through the injector cleaning apparatus and injector changes. While an O-ring type seal is shown for the upper injector seal 170 and the lower injector seal 172, alternate embodiments include other types and styles of seals known in the art.

Figure 11:
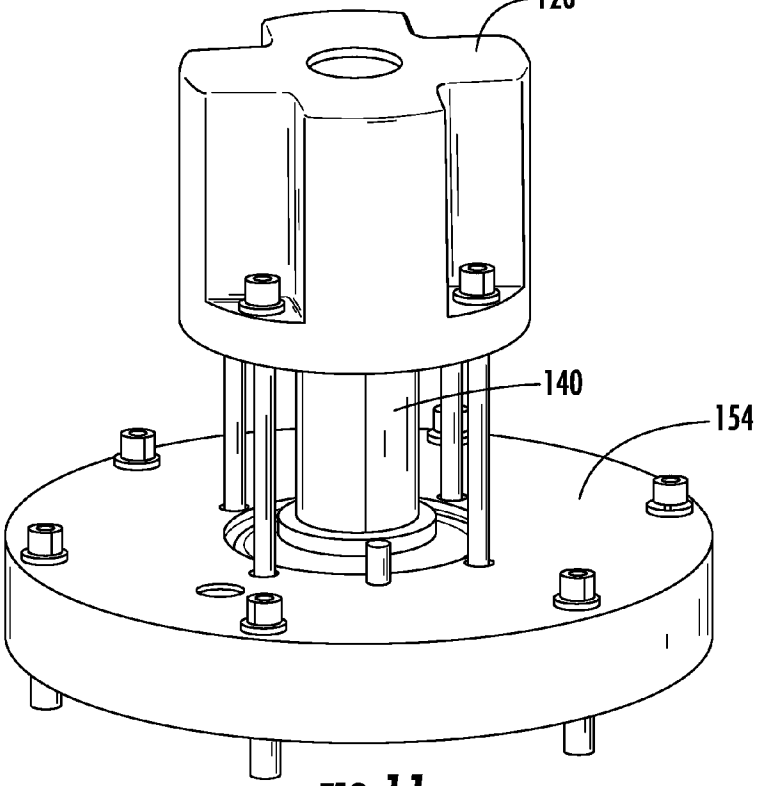
FIG. 11 is an isometric view of the upport portion of an injector cleaning apparatus according to one embodiment of the present disclosure with the spacer ring removed.

Referring to FIG. 11, the relationship between the injector 140, the outer base ring 154, and the concentric dual flow introducer 120 is shown for an embodiment of the present invention. The injector 140 interfaces with the flow-dispersing injector seat 166 at one end of the injector and interfaces with the concentric dual flow introducer 120 at the other end of the injector.

Referring again to FIGS. 2A and 2B, the injector 140 disposed in the injector cleaning apparatus is shown. The injector 140 is shown as a silhouette without any internal details for clarity of the surrounding injector cleaning apparatus 100 structure. The concentric dual flow introducer 120 comprises an input-side injector engaging interface 114. The input-side injector engaging interface 114 includes a compressible sealing portion and a rigid facing portion. The compressible sealing portion of the input-side injector engaging interface 114 preferably has compressibility sufficient to yield under fluid cleaning surges attributable to initiation and termination of cleaning fluid flow through the injector cleaning apparatus 100. The compressible sealing portion of the input-side injector engaging interface 114 preferably also has resiliency sufficient to prevent abutment of a gas injector and the rigid facing portion of the input-side injector engaging interface and maintain an input-side injector floating gap between an injector and the rigid facing portion of the input-side injector engaging interface. In an embodiment, the upper injector seal 170 is the compressive sealing portion of the input-side injector engaging interface 114.

The flow-dispersing injector seat 166 comprises an output-side injector engaging interface 116. The output-side injector engaging interface 116 includes a compressible sealing portion and a rigid facing portion. The compressible sealing portion of the output-side injector engaging interface 116 preferably has compressibility sufficient to yield under fluid cleaning surges attributable to initiation and termination of cleaning fluid flow through the injector cleaning apparatus 100. The compressible sealing portion of the output-side injector engaging interface 116 preferably also has resiliency sufficient to prevent abutment of a gas injector and the rigid facing portion of the output-side injector engaging interface and maintain an output-side injector floating gap between an injector and the rigid facing portion of the output-side injector engaging interface. In an embodiment, the lower injector seal 172 is the compressive sealing portion of the output-side injector engaging interface 116.

Figure 12:
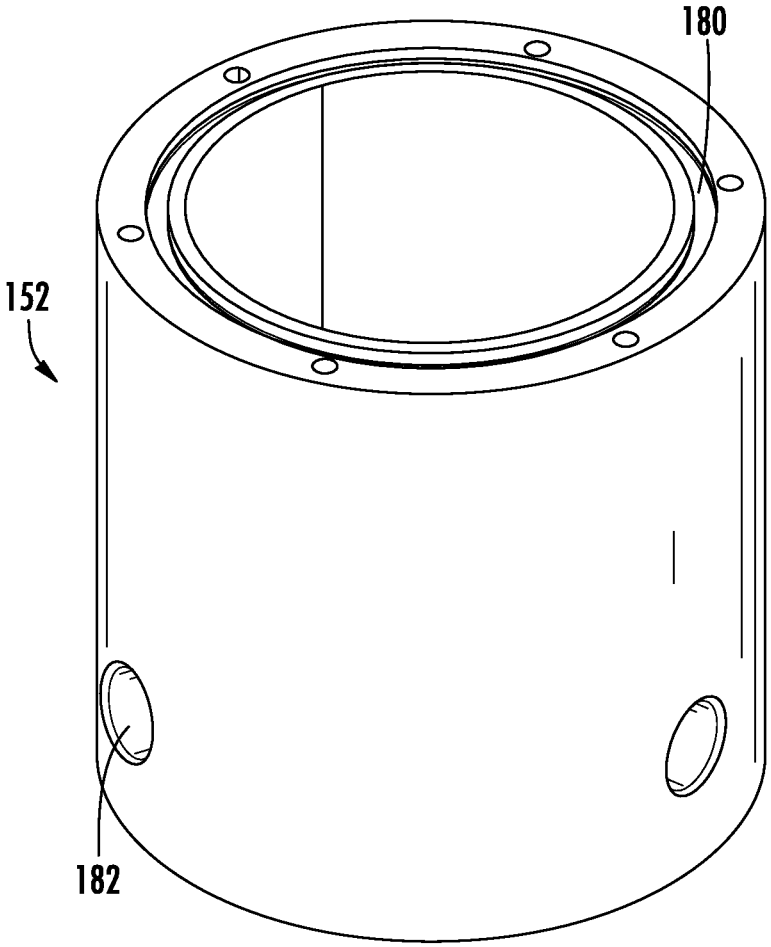
FIG. 12 is an isometric view of a discharge chamber according to one embodiment of the present disclosure.

Referring to FIG. 12, the end detail of the discharge chamber 152 is shown. The periphery of an end of the discharge chamber 152 comprises an optional outer base ring seal channel 180. The outer base ring seal channel 180 is a recessed channel, sized to hold the outer base ring seal 164. The discharge chamber 152 also comprises at least one discharge port 182 to provide a pathway for fluid discharge from the injector 140 during an injector cleaning operation.

Figure 13A:
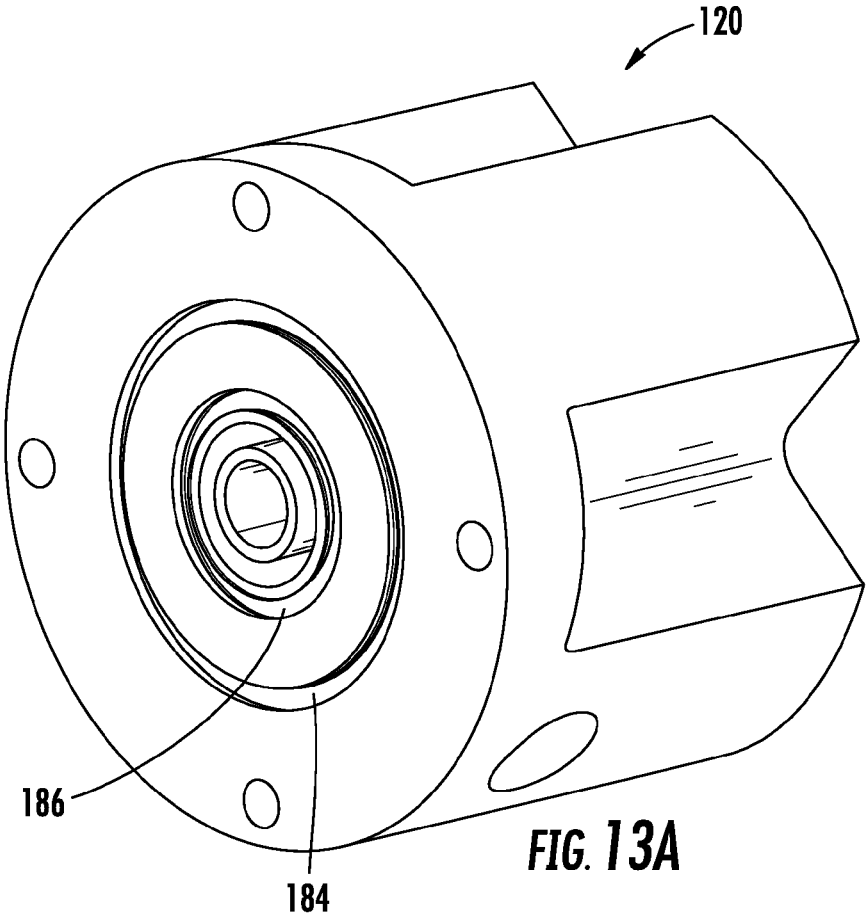
FIG. 13A is an isometric view of a concentric dual flow introducer according to one embodiment of the present disclosure.
Figure 13B:
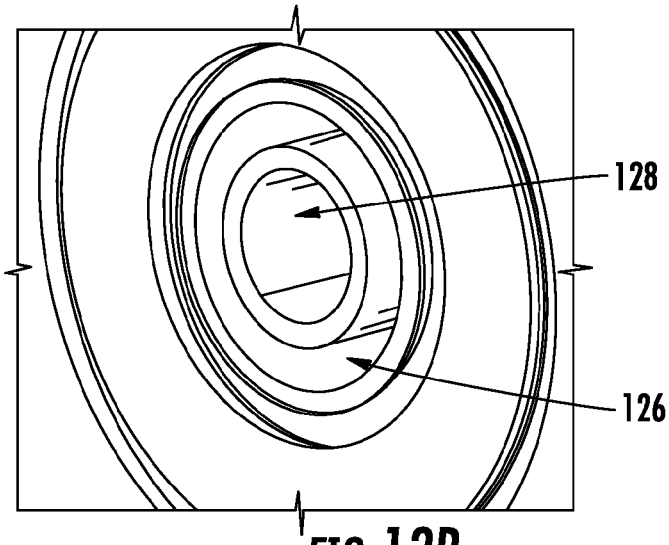
FIG. 13B is a detail view of FIG. 13A.

Referring to FIG. 13A, the end detail of the concentric dual flow introducer 120 is shown. The periphery of an end of the concentric dual flow introducer 120 comprises an optional flow introducer seal channel 184 and an optional upper injector seal channel 186. The flow introducer seal channel 184 is a recessed channel sized to hold the flow introducer seal 156. The upper injector seal channel 186 is a recessed channel sized to hold the upper injector seal 170. Further, FIG. 13B, a detailed view of FIG. 13A, shows the outer passage 126 and the inner passage 128.

Figure 14B:
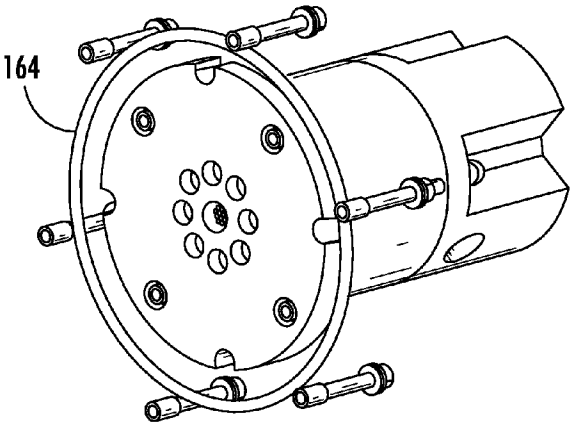
FIG. 14B is an isometric view of the upper portion of an injector cleaning apparatus according to one embodiment of the present disclosure with the outer base ring removed.
Figure 14D:
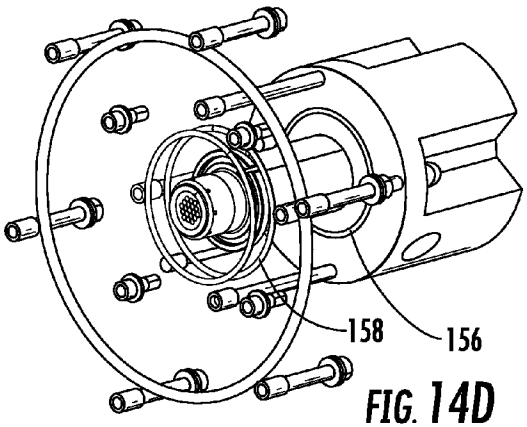
FIG. 14D is an isometric view of the upper portion of an injector cleaning apparatus according to one embodiment of the present disclosure with the spacer ring further removed.
Figure 14A:
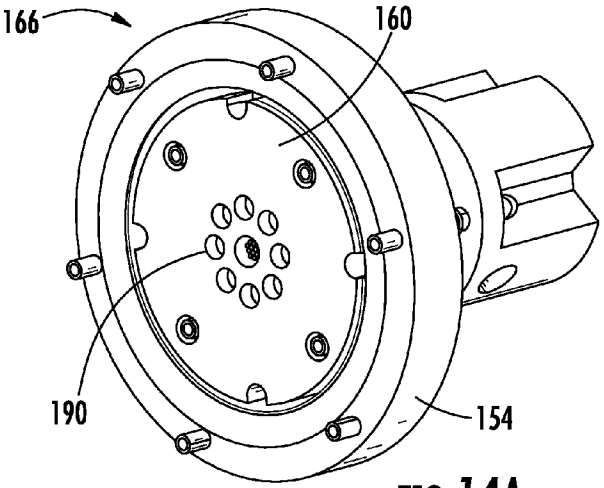
FIG. 14A is an isometric view of the upper portion of an injector cleaning apparatus according to one embodiment of the present disclosure.
Figure 14C:
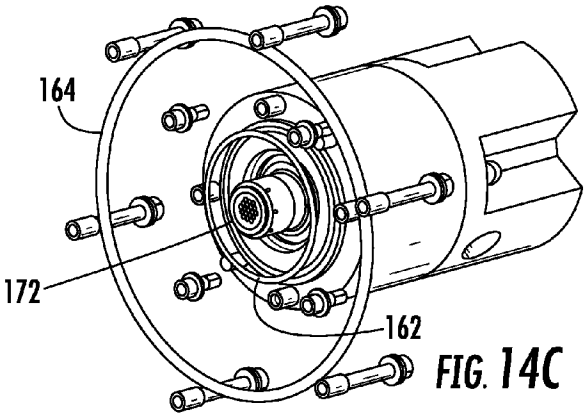
FIG. 14C is an isometric view of the upper portion of an injector cleaning apparatus according to one embodiment of the present disclosure with the inner base ring further removed.

Referring to FIG. 14A, the inner base ring 160 is shown. The inner base ring 160 has at least one perforation 190 to allow the discharge from the peripheral outlets 142 and the central outlets 144 of the injector 140 to pass through the inner base ring. The at least one perforation 190 is in alignment with the peripheral outlets 142 and the central outlets 144 of the injector 140 allowing the injector discharge to pass through unimpeded. FIG. 14B shows the outer base ring 154 removed to reveal the positioning of the outer base ring seal 164. FIG. 14C further shows the inner base ring 160 removed to reveal the positioning of the inner base ring seal 162 and lower injector seal 172. FIG. 14D still further shows the spacer ring 150 removed to reveal the spacer ring seal 158 and the flow introducer seal 156.

Figure 15B:
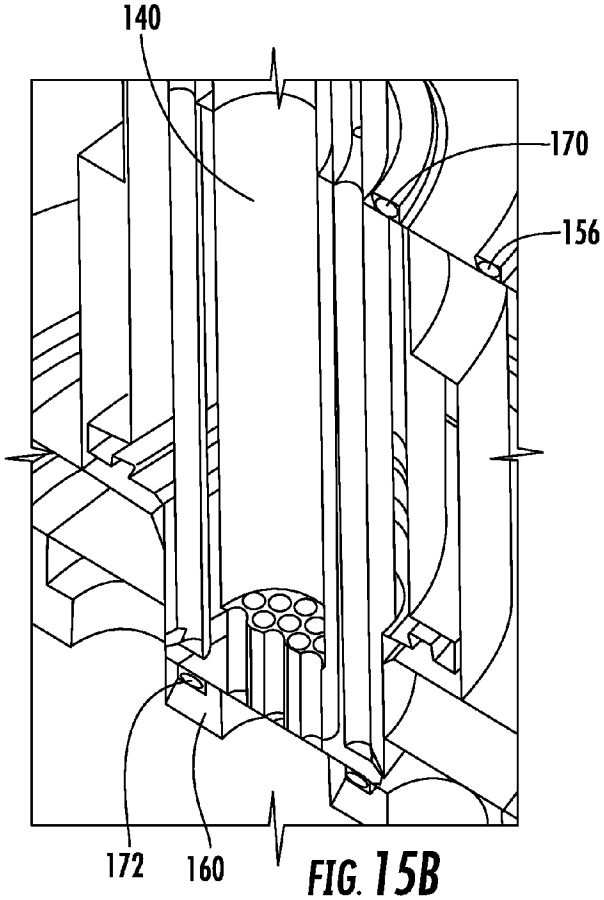
FIG. 15B is a detail view of 15A.
Figure 15A:
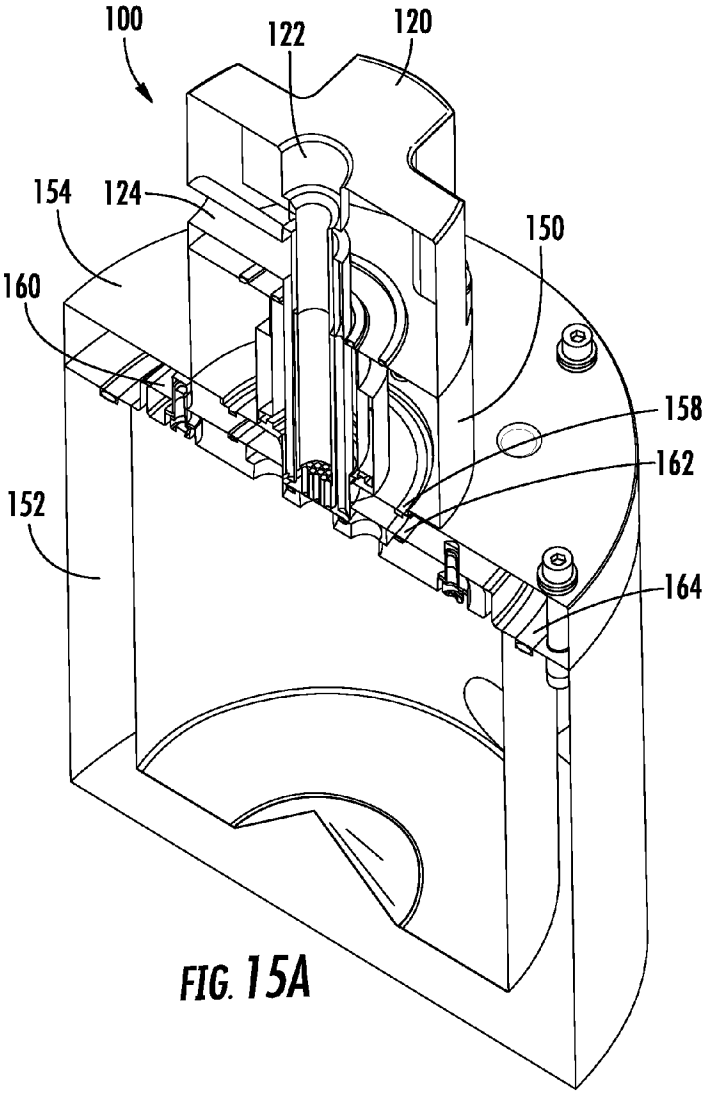
FIG. 15A is an isometric cut view of an injector cleaning apparatus according to one embodiment of the present disclosure.

Referring to FIGS. 15A and 15B, a cross-section of an embodiment of the injector cleaning apparatus 100 with an injector 140 in place is shown. Structures previously disclosed and their relationships are shown.

The parts of the injector cleaning apparatus 100 touching the injector 140 may be polypropylene or other material which is suitable to be in contact with the injector. The remainder of the parts may be made from nylon or other material suitable for the conditions. All wetted surfaces may not be made from stainless steel.

The injector cleaning apparatus 100 serves to clean the injector 140. The cleaning procedure is intended to remove particles, for example ceramic and Yttria particles, from the injector's 140 confined surfaces. It is believed particles, such as ceramic and Yttria particles, are not removed by conventional rinsing or ultrasonic cleaning methods. The injector cleaning apparatus 100 serves to clean and flush out particles following conventional scrub and ultrasonic cleaning.

Removal of particles from the injector 140 is important for defect-free performance. During operation, such as plasma processing of a semiconductor wafer substrate, debris and particulates in the injector 140 can result in defects in the finished product.

An embodiment of the injector cleaning process comprises introduction of a fluid into the Inner Zone 110 and the Outer Zone 112 of the injector cleaning apparatus 100. Fittings which interface with the inner zone aperture 122 and the outer zone aperture 124 may be used to connect the outer flow control module 102 and inner flow control module 106 to the injector cleaning apparatus 100. Fluid introduced through the inner zone aperture 122 passes through the inner passage 128. Fluid introduced through the outer zone aperture 124 passes through the outer passage 126. These independent pathways allow different pressures and flow rates to be used for fluids passing through the Inner Zone 110 and the Outer Zone 112. Additionally, it is envisioned that secondary cleaning agents such as a detergent or enzyme could be included in one flow stream and excluded from another.

After passing through the inner passage 128 and the outer passage 126, the fluid is introduced into the injector 140 to complete the cleaning function. Fluid from the inner passage 128 is introduced into the central passage 148 of the injector 140, passes through the central passages, and is ejected through the central outlets 144. Fluid from the outer passage 126 is introduced into the peripheral passages of the injector 140, passes through the peripheral passages, and is ejected through the peripheral outlets 142. The fluid discharged from the peripheral outlets 142 and central outlets 144 passes through the at least one perforation 190 of the inner base ring 160 allowing the fluid to enter the discharge chamber 152. From the discharge chamber 152, the fluid exits the injector cleaning apparatus 100 though the at least one discharge port 182.

Bevels, tapers, chamfers, fillets, rounding, and other corner treatments are shown throughout the disclosed drawings. These corner treatments may not be required and the present disclosure includes those unillustrated embodiments where the corner treatments are not present. Further, embodiments are envisioned in which corners and edges which are not shown with corner treatment are beveled, tapered, chamfered, filleted, rounded, or treated with another corner treatment.

Throughout the disclosed drawings fasteners are shown to hold components of the injector cleaning apparatus 100 together in an assembled configuration. The type and style of fastener shown is illustrative only with further types and styles of fasteners known in the art envisioned as further embodiments.

It is also noted that recitations herein of "at least one" component, element, etc., should not be used to create an inference that the alternative use of the articles "a" or "an" should be limited to a single component, element, etc.

It is noted that terms like "preferably," "commonly," and "typically," when utilized herein, are not utilized to limit the scope of the claimed invention or to imply that certain features are critical, essential, or even important to the structure or function of the claimed invention. Rather, these terms are merely intended to identify particular aspects of an embodiment of the present disclosure or to emphasize alternative or additional features that may or may not be utilized in a particular embodiment of the present disclosure.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Rather, the claims appended hereto should be taken as the sole representation of the breadth of the present disclosure and the corresponding scope of the various inventions described herein. Further, it will be apparent that modifications and variations are possible without departing from the scope of the invention defined in the appended claims. More specifically, although some aspects of the present disclosure are identified herein as preferred or particularly advantageous, it is contemplated that the present disclosure is not necessarily limited to these aspects.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. An injector cleaning apparatus comprising a concentric dual flow introducer and a flow-dispersing injector seat, wherein:

the concentric dual flow introducer comprises an inner concentric cleaning fluid flowpath configured to communicate with a central passage of a gas injector, an outer concentric cleaning fluid flowpath configured to communicate with a plurality of peripheral passages of the gas injector, and an input-side injector engaging interface comprising a compressible sealing portion and a rigid facing portion, the compressible sealing portion of the input-side injector engaging interface having compressibility sufficient to yield under cleaning fluid surges attributable to initiation and termination of cleaning fluid flow through the injector cleaning apparatus and resiliency sufficient to prevent abutment of the gas injector and the rigid facing portion of the input-side injector engaging interface and maintain an input-side injector floating gap between the gas injector and the rigid facing portion of the input-side injector engaging interface, wherein the concentric dual flow introducer interfaces with a first end of the gas injector at the input-side injector engaging interface; and the flow-dispersing injector seat comprises an output-side injector engaging interface comprising a compressible sealing portion and a rigid facing portion, the compressible sealing portion of the output-side injector engaging interface having compressibility sufficient to yield under cleaning fluid surges attributable to initiation and termination of cleaning fluid flow through the injector cleaning apparatus and resiliency sufficient to prevent abutment of the gas injector and the rigid facing portion of the output-side injector engaging interface and maintain an output-side injector floating gap between the gas injector and the rigid facing portion of the output- side injector engaging interface, the flow-dispersing injector seat interfacing with a second end of the gas injector.

2. The injector cleaning apparatus of claim 1, wherein the injector cleaning apparatus further comprises an inner flow control module to regulate flow of deionized water and compressed dry air to the inner concentric cleaning fluid flowpath and an outer flow control module to regulate flow of deionized water and compressed dry air to the outer concentric cleaning fluid flowpath.

3. The injector cleaning apparatus of claim 2 wherein the inner flow control module, the outer flow control module, or both comprise at least one valve, at least one pressure regulator, and at least one flow regulator.

4. The injector cleaning apparatus of claim 1 wherein the compressible sealing portion of the input-side injector engaging interface; the compressible sealing portion of the output-side injector engaging interface or both the compressible sealing portion of the input-side injector engaging interface and the compressible sealing portion of the output-side injector engaging interface comprise 0-ring type seals.

5. The injector cleaning apparatus of claim 4 wherein both the compressible sealing portion of the input-side injector engaging interface and the compressible sealing portion of the output-side injector engaging interface comprise O-ring type seals.

6. The injector cleaning apparatus of claim 1 wherein the compressible sealing portion of the input-side injector engaging interface is disposed in a recessed channel formed in the concentric dual flow introducer and the compressible sealing portion of the output-side injector engaging interface is disposed in a recessed channel formed in the flow-dispersing injector seat.

7. The injector cleaning apparatus of claim 1 wherein the injector cleaning apparatus further comprises a discharge chamber to collect and drain fluid discharge from the flow-dispersing injector seat.

8. The injector cleaning apparatus of claim 1 wherein the injector cleaning apparatus further comprises a spacer ring disposed between the flow-dispersing injector seat and the concentric dual flow introducer.

9. The injector cleaning apparatus of claim 1 wherein the flow-dispersing injector seat further comprises an inner base ring and an outer base ring.

10. The injector cleaning apparatus of claim 1 wherein all wetted surfaces are not comprised of stainless steel.

11. The injector cleaning apparatus of claim 1 wherein the flow-dispersing injector seat and concentric dual flow introducer are comprised of polypropylene.

12. An injector cleaning apparatus comprising a concentric dual flow introducer, a flow-dispersing injector seat, an inner flow control module, and an outer flow control module, wherein:

the concentric dual flow introducer comprises an inner concentric cleaning fluid flowpath configured to communicate with a central passage of a gas injector, an outer concentric cleaning fluid flowpath configured to communicate with a plurality of peripheral passages of the gas injector, and an input-side injector engaging interface comprising a compressible sealing portion and a rigid facing portion, the compressible sealing portion of the input-side injector engaging interface having compressibility sufficient to yield under cleaning fluid surges attributable to initiation and termination of cleaning fluid flow through the injector cleaning apparatus and resiliency sufficient to prevent abutment of the gas injector and the rigid facing portion of the input-side injector engaging interface and maintain an input-side injector floating gap between the gas injector and the rigid facing portion of the input-side injector engaging interface, wherein the concentric dual flow introducer interfaces with a first end of the gas injector at the input-side injector engaging interface; and the flow-dispersing injector seat comprises an output-side injector engaging interface comprising a compressible sealing portion and a rigid facing portion, the compressible sealing portion of the output-side injector engaging interface having compressibility sufficient to yield under cleaning fluid surges attributable to initiation and termination of cleaning fluid flow through the injector cleaning apparatus and resiliency sufficient to prevent abutment of the gas injector and the rigid facing portion of the output-side injector engaging interface and maintain an output-side injector floating gap between the gas injector and the rigid facing portion of the output-side injector engaging interface and the flow-dispersing injector seat further comprises an inner base ring and an outer base ring, the flow-dispersing injector seat interfacing with a second end of the gas injector at the output-side injector engaging interface;

the inner flow control module is configured to regulate flow of deionized water and compressed dry air to the inner concentric cleaning fluid flowpath; and the outer flow control module is configured to regulate flow of deionized water and compressed dry air to the outer concentric cleaning fluid flowpath.

* * * * *